United States Patent [19]

Messina

[11] Patent Number: 5,038,422

[45] Date of Patent: Aug. 13, 1991

[54] SUPPORT STRUCTURE FOR SOFA BEDS, WITH PULL-OUT, RAISABLE AUXILIARY BED

[75] Inventor: Rosario Messina, Seregno, Italy

[73] Assignee: Flou S.P.A., Meda, Italy

[21] Appl. No.: 404,871

[22] Filed: Sep. 8, 1989

[30] Foreign Application Priority Data

Sep. 13, 1988 [IT] Italy ..... 21916 A/88

[51] Int. Cl.[5] ..... A47C 17/13; A47C 17/32

[52] U.S. Cl. ..... 5/21; 5/12.1; 5/51.1

[58] Field of Search ..... 5/21, 18.1, 9.1, 11, 5/12.1, 63, 17, 8.1, 51.1

[56] References Cited

U.S. PATENT DOCUMENTS

| | | | |
|---|---|---|---|
| 2,557,692 | 6/1951 | Robinson | 5/21 |
| 2,876,463 | 3/1959 | Barath | 5/21 |
| 3,253,283 | 5/1966 | Jörgensen et al. | 5/21 |
| 3,282,566 | 4/1966 | Clarke | 5/63 |
| 3,855,650 | 12/1974 | Neunherz et al. | 5/21 |
| 4,556,198 | 12/1985 | Tominaga | 5/63 |
| 4,953,242 | 9/1990 | Harris | 5/18.1 |

FOREIGN PATENT DOCUMENTS

| | | | |
|---|---|---|---|
| 802084 | 12/1950 | Fed. Rep. of Germany | 5/18.1 |

*Primary Examiner*—Alexander Grosz
*Attorney, Agent, or Firm*—Herbert Dubno

[57] ABSTRACT

Support structure for sofa beds, with pull-out, raisable auxiliary bed, which comprises an upper frame carrying support means for a mattress and connected, by means of rods linked as a parallelogram, to two lower bars transverse to the larger dimension of the frame, blocking means being present for the raised position and balancing means for the weight of the frame, the sofa bed being equipped with a seat-back adjustable in position.

10 Claims, 4 Drawing Sheets

SUPPORT STRUCTURE FOR SOFA BEDS, WITH PULL-OUT, RAISABLE AUXILIARY BED

FIELD OF THE INVENTION

The subject of the present invention is a support structure for sofa beds, with pull-out, raisable auxiliary bed.

THE RELATED ART

In a home, it is frequently necessary to have available a bed over and above those normally in use. Where there is limited space available, the extra bed can be concealed in storage during the day. In such circumstances, auxiliary beds are frequently stored, when not in use, in a space formed beneath a bed or sofa bed.

This then requires that such auxiliary bed shall have limited overall height, not very much greater than the thickness of its mattress. During use, furthermore, it is desirable that the auxiliary bed shall be situated at a higher level, in order to be more comfortable or so that it may be coupled to the bed from beneath which it has been pulled out, in order to form a double bed.

For this purpose there are known bed frames for auxiliary beds which have folding legs. For use, the legs must be extended once the bed frame has been pulled out from its location.

Such an operation is , however, tedious and difficult and therefore the need arises to provide a structure for an auxiliary bed, or emergency bed, which can be put away with reduced bulk and can be pulled out for use in an easy manner, providing in such a condition a bed in every way analogous to a fixed bed.

These results are achieved by the present invention, which provides a support structure for sofa beds, which comprises an upper frame, carrying support means for a mattress, this upper frame being connected by means of rods linked to form a parallelogram to two lower bars, transverse to the larger dimension of the frame, blocking means being present for the raised position and balancing means for the weight of the frame, the sofa bed being equipped with a seat-back adjustable in position.

The rods linked to form a parallelogram are composed of two pairs of rods, articulated to each other at an intermediate position, and connected at one end, respectively, to the upper frame and to a lower bar by fixed axes, the rods being equipped at their opposite end with respective pins inserted into slots extending horizontally in the frame and in the lower bar.

The blocking means for the raised position are constituted of hook elements capable of engaging with the pins slidable in the slots of the upper frame, these hook elements being adapted for blocking the sliding of the pins in said slots, and being equipped with means for manual disengagement.

The balancing means for the weight of the frame are constituted of elastic elements, interposed between the upper frame itself and the lower bars.

Advantageously, these elements are constituted of pneumatic springs.

The elastic elements are disposed with their axis oblique, with the effective thrust component overcoming the weight to be raised only beyond a partially raised position of the upper frame.

The sofa bed possesses lateral arm rests and a seat-back, attached to the arm rests by U-shaped saddles fitted on the upper edges of the arm rests and articulated to the sides of said seat-back, the U-shaped saddles being secured to the edges of the arm rests by friction in any position.

The upper edges of the arm rests are constructed of plastics material of limited hardness and U-shaped saddles are fitted onto them with moderate elastic force.

The saddles are constructed of plastics material of limited hardness, with an internal metal core.

The seat-back is articulated to the saddles by means of pins projecting from said saddles, these pins being disposed in an asymmetric position on the saddles, near one lateral edge.

BRIEF DESCRIPTION OF THE DRAWING

Further details will become apparent from the following description, with reference to the attached drawings, in which there are shown.

DETAILED DESCRIPTION

Figure 1:
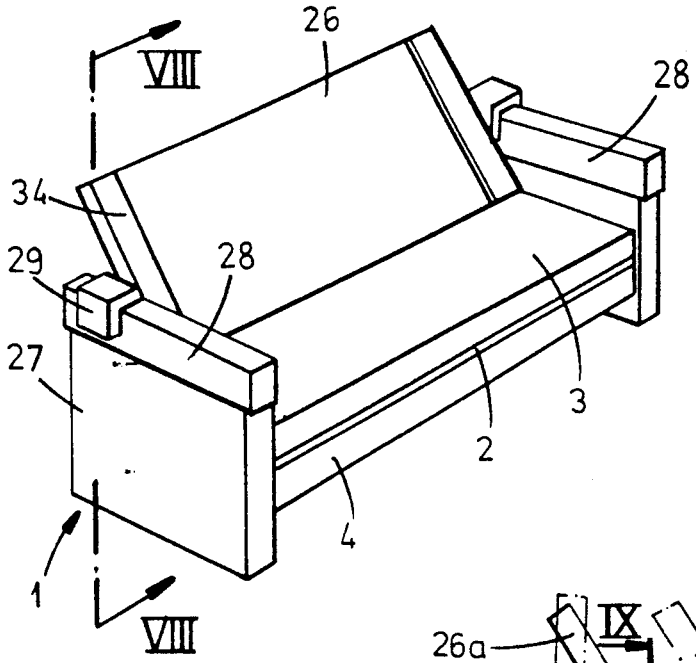
FIG. 1 which is a sofa bed according to this invention.
Figure 2:
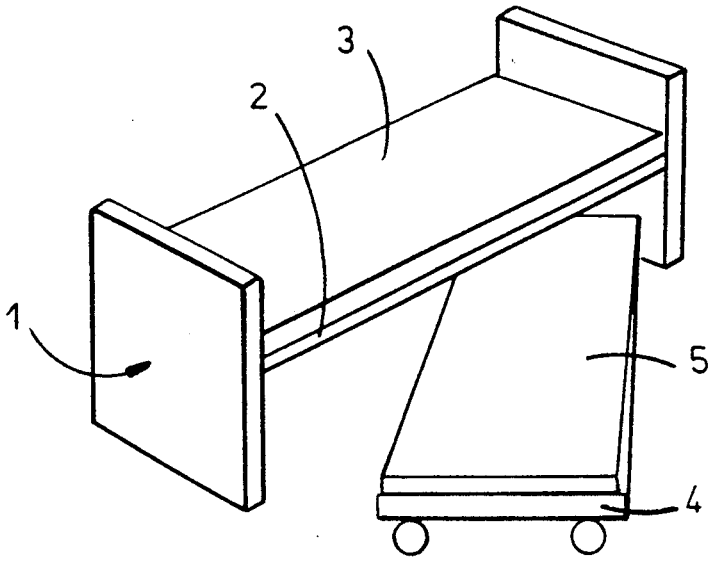
PRIOR ART FIG.2
FIG. 2 which is the sofa bed of FIG. 1 with the auxiliary bed lowered and partly pulled out.

As FIGS. 1 and 2 show, there are well-known sofa beds 1 which possess a second bed 4 which can be pulled out for use in case of need. Second bed 4 is below bed frame 2 the latter comprising a bed spring mesh or the like which carries a mattress 3.

The second bed must possess a support structure which should have a sufficiently restricted height to allow this bed, complete with associated mattress 5, to be inserted beneath the bed frame 2 of the sofa bed 1; at the same time it is advisable, as illustrated in FIG. 2, that when the second bed 4 is in use, it should have its own mattress 5 disposed at the same level as the mattress 3 of the sofa bed 1, so that it may be equally comfortable and it should be possible to connect together the two beds 1 and 4 to form one double bed.

Figure 3:
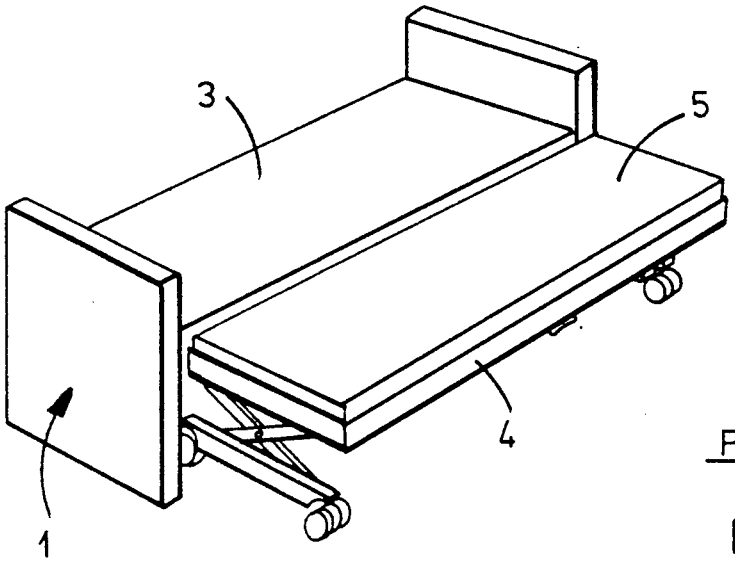
PRIOR ART FIG.3
FIG. 3 which is the sofa bed of FIG. 2 with the second bed pulled out and raised.

For this purpose, as can be better seen in FIG. 3, the bed 4 possesses a frame 6, carrying the support devices for the mattress, constituted as shown of a plurality of elastic strips 7, or of a spring mesh or similar means.

The frame 6 comprises, near its opposite shorter sides, a pair of cross-members 8, to each of which there is connected a pair of rods **9*a*, 9*b*, attached at the opposite end to the lower bars 10**, and articulated to each other at an intermediate position.

Figure 4:
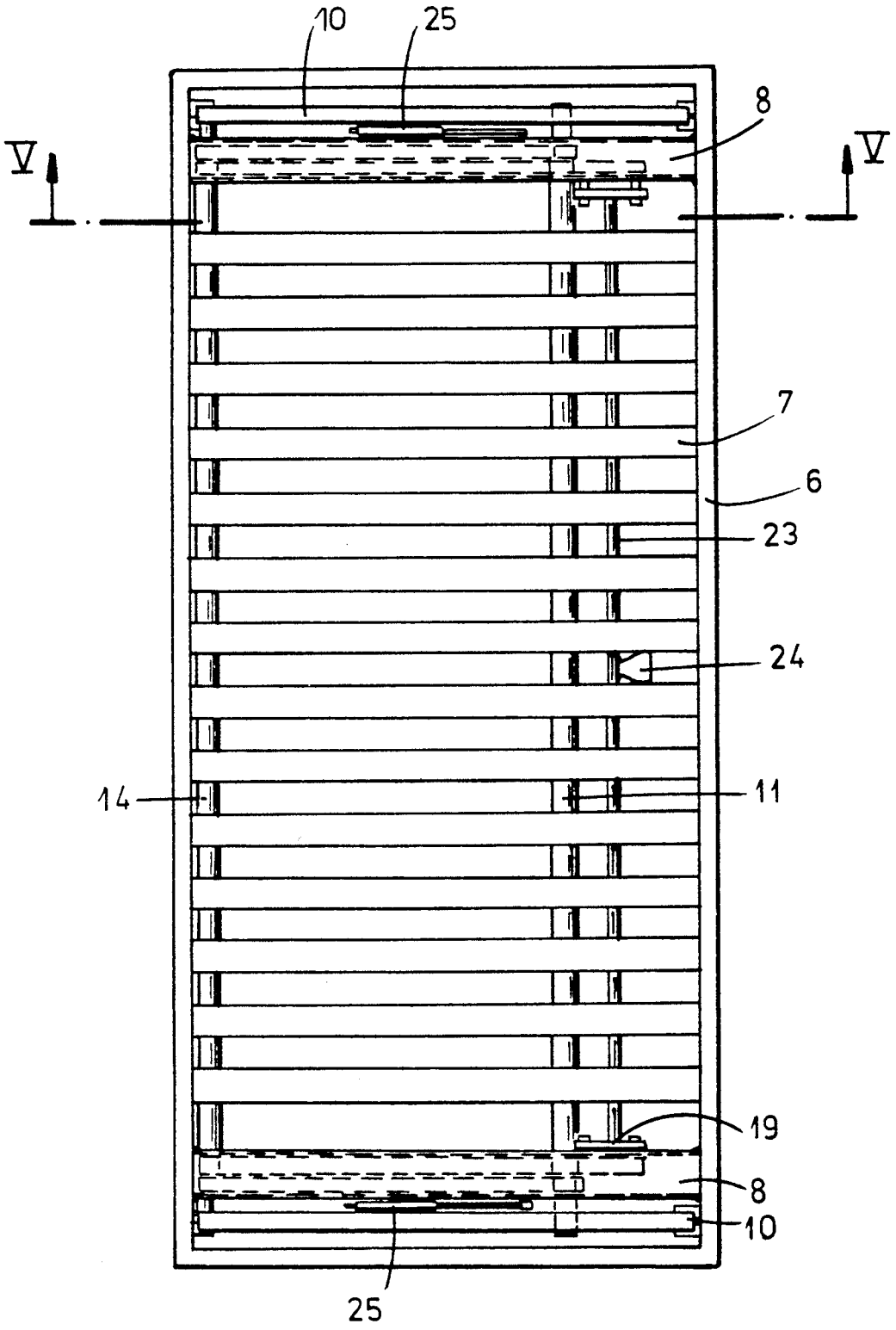
FIGS. 4 which is the support frame for the pull-out bed of FIG. 2 and 3, seen from above.
Figure 5:
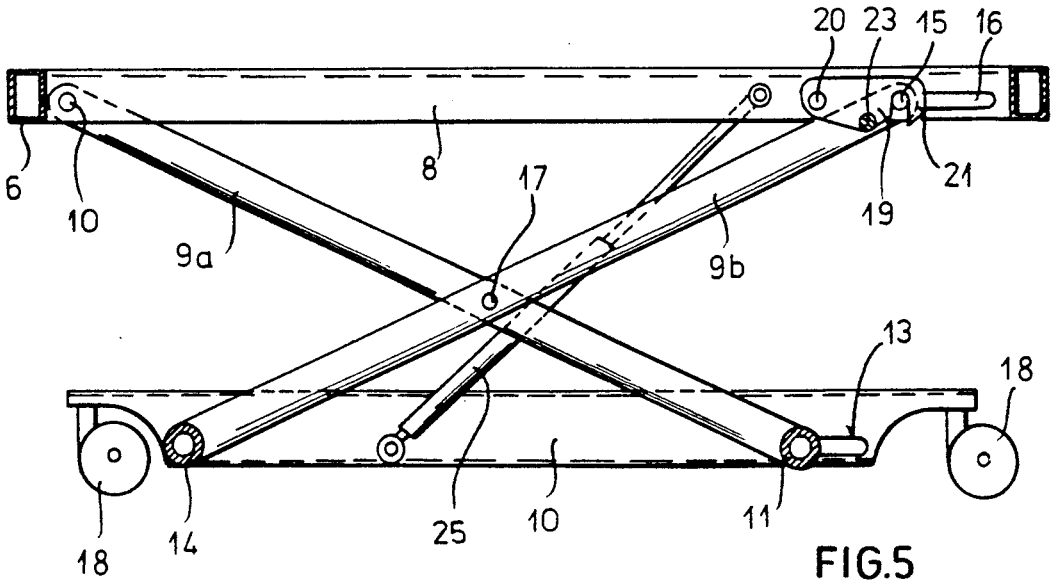
FIG. 5 which is a section on the plane V—V of FIG. 4, with the support frame for the mattress in the raised position.
Figure 6:
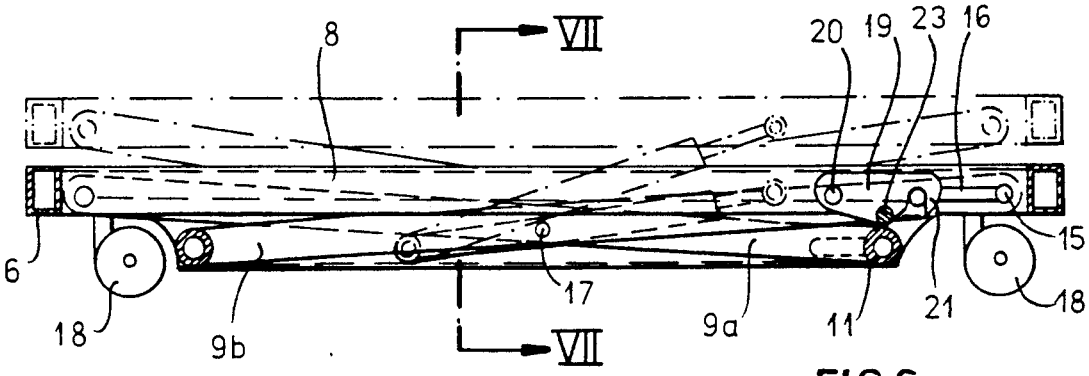
FIG. 6 which is the section of FIG. 5, with the support frame for the mattress in the lowered position.
Figure 7:
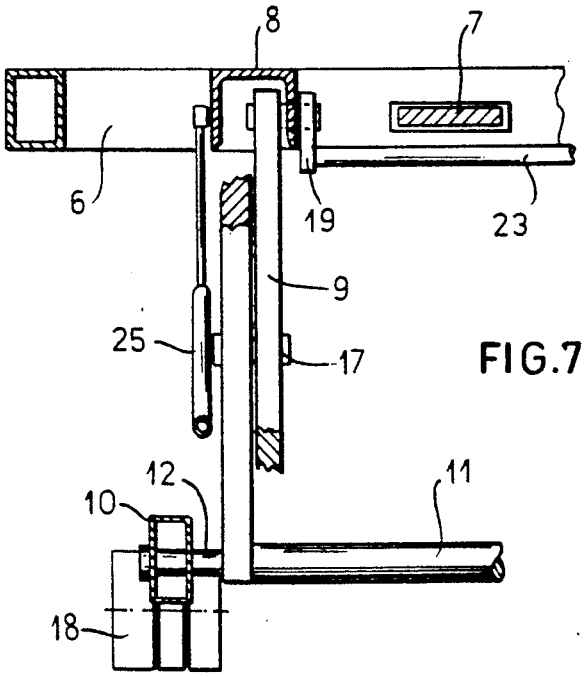
FIG. 7 which is a section on the plane VII—VII of the FIG. 6.

As FIGS. 4 to 6 show, each pair of rods comprises one rod **9*a* articulated by means of a fixed pin 40, to the cross-member of the frame 6 and attached at the opposite end to a tubular bar 11, which is continued by a pin 12, slidable in a slot 13 of lower bar 10**.

The other rod 9b, in turn, is articulated with a fixed axis to the lower bar 10 and is fixedly attached to a tubular bar 14 and carries at the opposite end a pin 15, slidable in a slot 16 of the cross-member 8 of the frame 6.

A pin 17 connects together the rods of a pair. The lower bars 10 are equipped, at the ends, with pivoting wheels or casters 18, by means of which the complete structure rests on the floor.

Advantageously, the casters 18 are of the type which are self-locking under loads greater than a predetermined value, thereby ensuring that the bed 4 will not move about during use, under the weight of a person resting on it, while the bed itself can be easily displaced when it is not loaded.

The rods 9a, 9b form an articulated scissors complex which allows the frame 6 to move transversely to the lower bars 10 and parallel to them, through a distance determined by the length of the slots 13, 16.

The cross-members 8, in correspondence with the pins 15 of the rods 9b, inserted into the slots 16, each carry a hook 19, attached in articulated manner to the respective cross-member by a pin 20; these hooks, during the raising of the frame 6, come into contact, by their chamfered front edge 21, with the pins 15 when these pins are near the end of the slot 16 and then engage, by a throat, on the pins themselves, thus maintaining the position of maximum lift of the frame 6.

A subsequent lowering of the frame 6 is made possible by raising the hooks 19 by means of rod 23, which connects them together and which advantageously carries a gripping handle 24.

Between the cross-members 8 of the frame 6 and the lower bars 10, there are also interposed the pneumatic springs 25, provided as a whole with a sufficient thrust force to overcome the self-weight of the frame 6 and of the mattress resting on it.

As can be seen from FIGS. 4 and 5, the pneumatic springs 25 are obliquely aligned, so that they are more or less parallel to the bars 10 and to the frame 6 when the latter is in its lowered position; in this manner, in the fully lowered position of the frame 6, the effective thrust of the pneumatic springs 25 for raising the frame 6, that is to say the upwardly orientated component of the thrust of the springs, is fairly small, and is smaller than the weight of the frame and mattress resting on it, so as to keep the lowered position stable.

It is only when the frame 6 is raised by hand, beyond a certain position shown purely for purposes of illustration in dot-and-dash line in FIG. 6, that the thrust provided by the pneumatic springs becomes sufficient for the raising which, from this point onwards, takes place automatically.

For returning the bed into the lowered position, the hooks 19 having been disengaged, a small push applied to the frame 6 overcomes the pneumatic springs 25 and then allows the assembly to be lowered.

Figure 8:
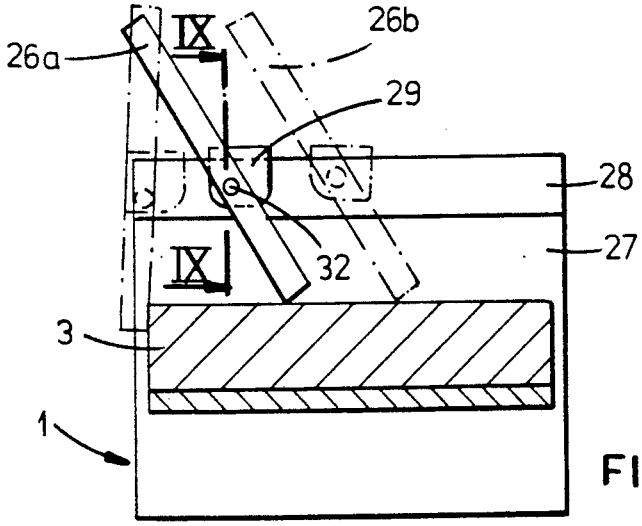
FIG. 8 which is a section on the plane VIII—VIII of FIG. 1.

The sofa bed 1 possesses a seat-back 26, which allows it to be used in a conventional manner as a sofa; this seat-back can be adjusted in position to provide a useful seating space suitable, as indicated schematically in FIG. 8, for example for the height of an adult in the position indicated by the reference 26a, or the height of a child, in the position 26b; furthermore, the seat-back can be brought to the rear end of the arm rests 27, where it may be rotated into a vertical position leaving the entire effective width of the mattress free for use as a bed.

Figure 9:
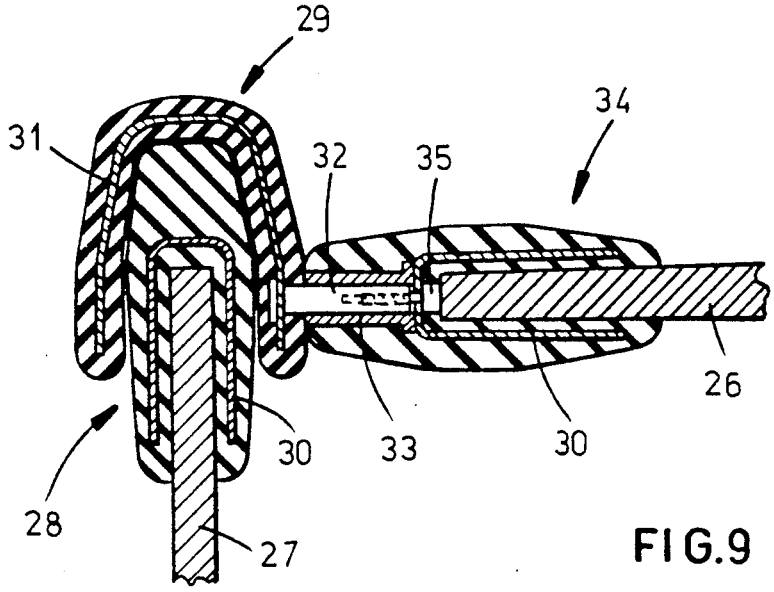
FIG. 9 which is a section on the plane IX—IX of FIG. 8.

For this purpose, the arm rests 27 are equipped with upper edges 28 and on these there are positioned the saddles 29, to which the seat-back 26 is attached in articulated manner; the saddles 29 are attached to the edges 28 by friction and can be slid by hand into the desired position. As FIG. 9 shows, the edges 28 are appropriately constructed of plastics material, such as expanded polyurethane, which assures a certain softness, equipped with a rigid core 30, appropriately of metal; on these arm rests are disposed the saddles 29, also constructed of plastics material and provided with a metal core 31, which assures that they retain their shape and provides a support for a pin 32, which penetrates into a metal sleeve 33 of the edge 34 of the seat-back, having a structure analogous to the edge 28 of the arm-rest, and is blocked against the metal core 30 of the edge 34 by means of a nut 35.

The seat-back can therefore be located in the desired position along the edges of the arm rests, and may be kept there by means of the friction exerted between the saddles and the edges, coupled together with moderate force; the pins 32 furthermore enable the seat-back to be tilted, so that it may be orientated as desired.

As FIG. 8 shows, the pins 32 are disposed in a lateral position on the saddles 29; in this manner it is possible to displace the saddles to the rear end of the edges of the arm rests, while still remaining firmly seated on them, so that the seat-back may be disposed in a substantially upright position laterally of the mattress 3, leaving the entire area free for use as a bed.

Numerous variants may be introduced, without thereby departing from the scope of the invention in its general characteristics.

I claim:

1. A sofa bed with a pull-out, raisable auxiliary bed, comprising:

a seat-back pivotable relative to the sofa bed between a generally vertical position in which the top surface of the sofa bed is adapted for sleeping on, and a slanted position in which the seat-back is adapted to provide a back support for a seated user, said seat-back, in its slanted position, being adjustable laterally relative to the top surface of the sofa bed to thereby provide back support for seated users of different sizes, with the auxiliary bed comprising;

an upper frame carrying a support means for a mattress;

two lower bars parallel to said upper frame;

a plurality of rods transverse to a larger dimension of said upper frame and connecting said upper frame to said lower bars;

means for blocking movement of said upper frame beyond a raised position; and means for balancing the weight of said upper frame, whereby the auxiliary bed can be moved between a first, stored position, underneath the sofa bed, and a second pulled-out position adjacent to and at substantially the same height as the sofa bed.

2. A sofa bed according to claim 1, wherein said plurality of rods comprises two pairs of rods articulated to one another in an intermediate position, secured at one end respectively to said upper frame and to one of said lower bars by fixed axes, and equipped at an opposite end with respective pins engaging into slots extending horizontally into said upper frame and into said lower bar.

3. A sofa bed according to claim 1, wherein said means for blocking movement comprises hook elements which may be engaged with at least one pin slidable in at least one slot of said upper frame, said hooks being adapted for blocking any sliding of said pin in said slot, and being equipped with manual disengagement means.

4. A sofa bed according to claim 1, wherein said means for balancing said weight of said upper frame comprises elastic elements interposed between said upper frame and said lower bars.

5. A sofa bed according to claim 4, wherein said elastic elements are constituted of pneumatic springs.

6. A sofa bed according to claim 4, wherein said elastic elements have an axis along a major length thereof and said axis is disposed at an oblique angle to said upper frame, said elastic elements having an effective thrust component overcoming said weight to be raised only beyond a partially raised position of said upper frame.

7. A sofa bed according to claim 4, further comprising lateral arm rests to which said seat-back is attached by means of U-shaped saddles engaged upon upper edges of said arm rests and connected in articulated manner to sides of said seat-back, said saddles being attached to said edges of said arm rests by friction in any position.

8. A sofa bed according to claim 7, wherein said upper edges of said arm rests are constructed of a plastic material of limited hardness and said U-shaped saddles are fitted onto said upper edges with moderate elastic force.

9. A sofa bed according to claim 8, wherein said U-shaped saddles are constructed of plastic material of limited hardness, with a metal internal core.

10. A sofa bed according to claim 7, wherein said seat-back is connected in articulated manner to said U-shaped saddles by means of pins projecting from said saddles, said pins being disposed in an asymmetric position on said saddles near a lateral edge thereof.

* * * * *